United States Patent [19]

Magers

[11] Patent Number: 4,915,663

[45] Date of Patent: Apr. 10, 1990

[54] IMAGE EXPANDING APPARATUS

[76] Inventor: Ronald G. Magers, 5 Allen Ave., Manchester, Mass. 01944

[21] Appl. No.: 75,770

[22] Filed: Jul. 20, 1987

[51] Int. Cl.[4] ..... A63H 33/32

[52] U.S. Cl. ..... 446/219; 446/147; 446/489; 40/427; 40/900; 272/8 M; 350/630; 350/4.1

[58] Field of Search ..... 446/147, 149, 151, 152, 446/219, 489; 40/219, 427, 582, 900; 272/8 R, 8 M, 8 N; 350/600, 630, 639, 4.1; 353/98; 358/238; 434/303, 331, 371

[56] References Cited

U.S. PATENT DOCUMENTS

| | | | |
|---|---|---|---|
| 169,882 | 11/1975 | Adams | 272/8 M |
| 2,381,801 | 8/1945 | Bloxom | 272/8 M X |
| 2,697,380 | 12/1954 | Wyser | 446/219 X |
| 2,776,179 | 1/1957 | Kemp et al. | 350/4.1 X |
| 3,099,933 | 8/1963 | Weiner | 350/4.1 |
| 3,164,923 | 1/1965 | Knott | 272/8.5 X |
| 3,603,663 | 9/1971 | Lewis | 350/4.1 |
| 3,834,051 | 9/1974 | Barnes, Jr. et al. | 40/582 X |
| 4,040,716 | 8/1977 | Matsubara | 350/4.1 |

FOREIGN PATENT DOCUMENTS

| | | | |
|---|---|---|---|
| 581650 | 10/1946 | United Kingdom | 40/427 |

OTHER PUBLICATIONS

*Astronomy* Magazine, Oct. 1989, p. 88, reference to SCT Telescope.

*Primary Examiner*—Robert A. Hafer
*Assistant Examiner*—Sam Rimell
*Attorney, Agent, or Firm*—Donald N. Halgren

[57] ABSTRACT

An optical toy image generator of the present invention comprises a parabolic reflector having a central opening for movable receipt of an image bearing shaft. The image bearing shaft contains a distorted representation which will appear on the shiny mirrored surface of the reflector as a dynamic changing proper image to the viewer who is facing the reflector's parabolic surface.

9 Claims, 2 Drawing Sheets

IMAGE EXPANDING APPARATUS

BACKGROUND OF THE INVENTION

1. Field of the Invention

This invention relates to optical devices, and particularly to optical toys.

2. Prior Art

Optical amusement devices have been around for many years. The most common type we have all grown up with is the kaleidoscope. An example of one such device is shown in La Reaux, Jr. U.S. Pat. No. 3,122,859. These devices usually comprise a telescoping arrangement of tubes through which a viewer looks, while rotating the tubes with respect to one another. An image is shown on flat surface at the distal end of the kaleidoscope.

An unusual optical device is disclosed in Barnes, Jr., et al U.S. Pat. No. 3,834,051, displaying an anamorphic greeting card. A distorted representation is attached to the front flap of a folded card assembly. A curved reflective surface "pops-up" when the card is opened. An intelligible representation of the image on the front flap may been seen by the viewer on the curved reflective "pop-up" surface.

Wyser U.S. Pat. No. 2,697,380 discloses an anamorphoscope wherein a series of large anamorphic pictures are reduced in size and viewed on a cone shaped mirror. The Wyser apparatus discloses a master tube and a carrier tube are arrange in a telescoping relationship. The carrier tube is transparent and has a cone shaped mirror at one end of the tube, and pointed toward the viewer. A large distorted picture is wrapped about the master roll, with the picture side disposed inwardly towards the carrier tube. As the carrier tube moves the cone shaped mirror through the master tube, the distorted image is transferred through the clear walls of the carrier tube and is viewable down the axis thereof, on the cone shaped mirror. Unfortunately, only a small image is represented, from a large distorted one, and the entire distorted image is viewed before and simultaneously with the viewing of the corrected image.

A further optical toy is shown in British Patent No. 581,650 (1946) to Bathurst wherein a cylindrical base holds a distorted picture thereon. A curved pillar, having a mirror finish, is arranged upwardly from the base. By viewing the pillar, a corrected representation of the distorted picture on the base, may be seen. This device also requires a large distorted image being reflected as a smaller undistorted image, with the entire distorted image being seen therewith.

It is an object of the present invention to provide an optical toy for producing an enlarged proper image from a smaller central image.

It is a further object of the present invention to produce an image a full 360° radially outwardly from the distorted image.

It is yet a further object of the present invention to provide an optical viewing device which is less complicated and more spectacular then those devices shown in the prior art.

BRIEF SUMMARY OF THE INVENTION

The present invention comprises an optical toy wherein a distorted picture is moved through a reflecting means to produce an enlarged proper image. The invention comprises a generally parabolic reflecting surface. The reflecting surface has a central opening defining a longitudinal axis.

A shaft carrying a distorted image wrapped therearound is disposed in the central opening of the reflecting surface. The shaft may be solid or hollow. The distorted image is placed on or in (the shaft would be transparent) so as to be facing radially outwardly.

The shaft, with the distorted image thereon or therein, would be displaced along the longitudinal axis of the reflecting surface and caused to pass through the central opening thereof.

The viewer would be facing the reflecting surface at its concave side. As the distorted image bearing means moves longitudinally through the central opening, the viewer is caused to see an undistorted proper image on the reflecting surface. The image is generated a full 360° around the shaft, onto the reflecting surface, enlarging the image from its original reduced size and distorted shape, to a proper, moving, representation of the picture the viewer is watching.

BRIEF DESCRIPTION OF THE DRAWINGS

The objects and advantages of the present invention will become more apparent when viewed in conjunction with the following drawings, in which.

DESCRIPTION OF THE PREFERRED EMBODIMENT

Figure 1:
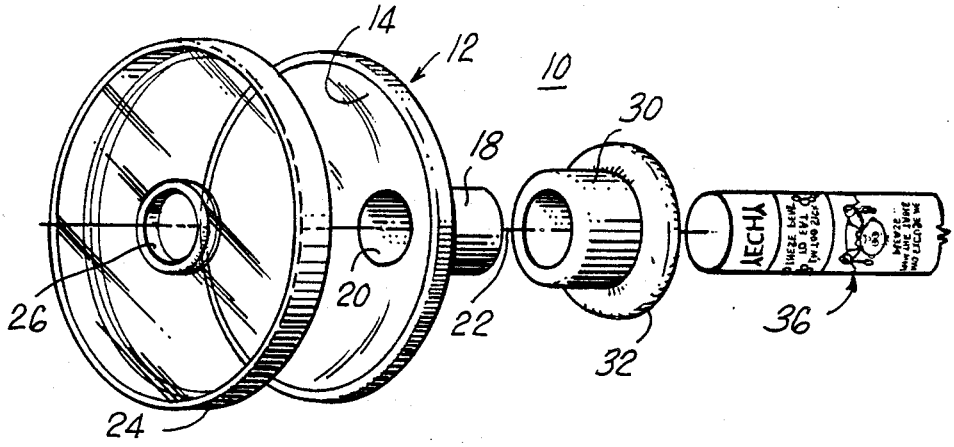
FIG. 1 is an exploded view of the optical device of the present invention.

Referring now to the drawings in detail, and particularly to FIG. 1, there is shown an optical toy assembly 10 comprising a reflector 12 having a shiny inner mirror-like surface 14 of generally concave configuration. The reflector 1 is preferably of parabolic shape. The reflector 12 has an outer surface 16 of convex configuration. The reflector 12 has a hub 18 centrally disposed on its outer surface 16.

The reflector 12 has a central opening 20 which is in communication with the hub 18. The opening 20 and the hub 18 have a longitudinal axis 22 which coincides with the focal point of the reflector 12.

Figure 2:
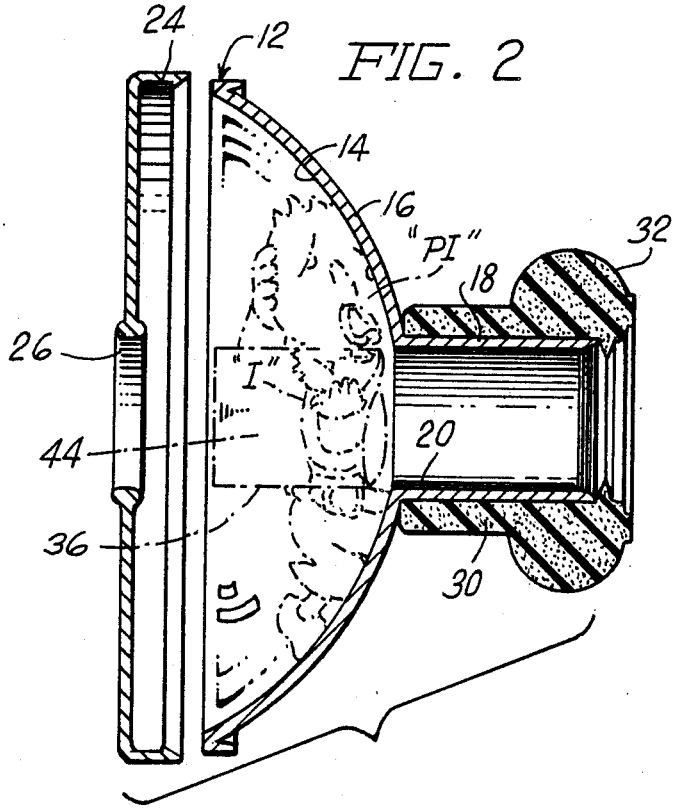
FIG. 2 is a cross-sectional view of the reflecting means and image viewing means.

A clear cover 24, shown in cross-section in FIG. 2, is disposable over the peripheral lip of the reflector 12. The cover 24 has a central opening 26 which is in coaxial alignment with the central opening 20 in the reflector 12 and the hub 18.

A resilient housing 30, having a generally cylindrical shape is frictionally mated with the hub 18. The housing 30, has an enlarged annular rim 32 at its distal end. The housing 30 is hollow, with an opening aligned with the channel through the hub 18.

Figure 3:
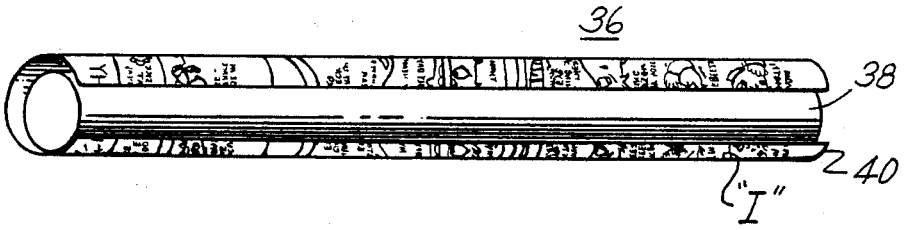
FIG. 3 is a side view of an image carrying means in a first embodiment.

An image bearing means 36, is shown in its preferred embodiment, in FIG. 3. The image bearing means 36 comprises a cylindrically shaped shaft 38, having a diameter which enables it to be displaced through the openings in the hub 18, reflector 12, and the cover 24. An image "I" is printed on a carrying medium 40 such as paper or the like, and is wrapped about the image bearing means 36. The image "I" on the medium 40 is of distorted configuration. The image "I" and and a proper image "PI" are represented in phantom lines in FIG. 2. The image shown on the image bearing means 36 is being reflected on the inner surface 14.

Figure 4:
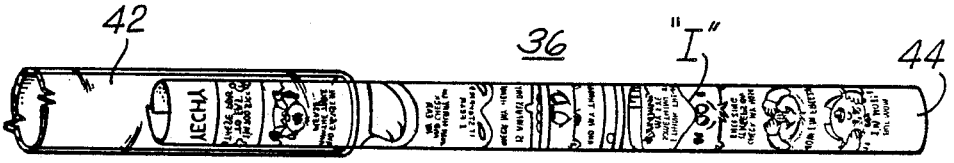
FIG. 4 is a side view of an image carrying means in an alternative embodiment.

A further embodiment of the image bearing means 36, is shown in FIG. 4, comprising a hollow transparent shaft 42 of a diameter similar to the shaft 38 of the aforementioned embodiment. An image "I" is printed on a carrying medium 44, and may be rolled up, image side being directed outwardly, and the medium 44 being placed within the hollow transparent shaft 42.

To operate the optical toy assembly 10, the housing 30 may be held in one hand, with the concave surface 14 being directed towards the viewer. The image bearing means 36 is moved longitudinally through the hub 18 and then out through the opening 20 in the reflector 12 and finally out through the opening 26 in the cover 24.

The distorted image "I" on the image bearing means 36 may be seen in a non-distorted proper image "PI" a full 360° around the image bearing means 36 in the reflector 12. The image in the shiny surface 14 of the reflector 12 moves and changes in accordance with the longitudinal movement of the image bearing means 36 along the longitudinal axis of the optical toy assembly 10.

Figure 5:
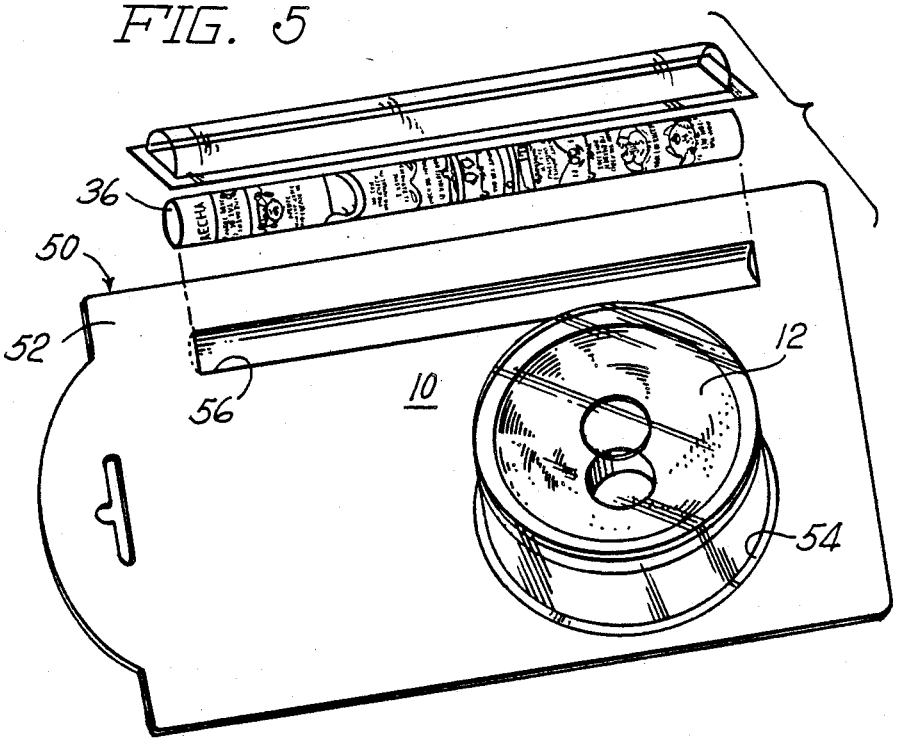
FIG. 5 is a perspective view of the optical device in a transport assembly arrangement.

The optical assembly 10, is shown in FIG. 5, in a perspective view, showing a carrying means 50 for shipment and sales purposes. The carrying means 50 may comprise a board 52 having openings 54 and 56 for the reflector 12 and image bearing means 36, respectively.

Thus there has been described a novel optical toy which permits full circular viewing of an enlarged proper image from a smaller distorted image moving through a central opening in a reflector.

I claim:

1. An optical image generating toy for generating an undistorted image from a distorted image, comprising:

a reflector means;

a central opening disposed in said reflector means;

an image bearing means receivable in said central opening to permit a distorted image carried by said image bearing means to be reflected as a proper image in said reflector means toward a viewer;

said reflector means comprising a reflector having a concave reflecting surface;

said image bearing means comprising a longitudinally movable shaft, movement of which through said opening displays an image upon said reflector.

2. An optical toy as recited in claim 1, wherein said image bearing means comprises a hollow transparent shaft having a medium facing outwardly to be reflected by said reflector means.

3. An optical image generating toy for displaying a larger undistorted image from a smaller distorted image comprising:

an outer concave reflecting means including a centrally disposed opening;.

a centrally disposed shaft longitudinally movable within said opening, said shaft including a distorted image means, said image means being viewable in undistorted form on said concave reflecting means.

4. An optical image generating toy as recited in claim 3, wherein said outer reflecting means comprises a parabolic reflector, having the central opening defining its longitudinal axis.

5. An optical image generating toy as recited in claim 4, wherein a transparent cover is disposed across said reflector, said cover having a central opening for passage of said image bearing means therethrough.

6. An optical image generating toy as recited in claim 1, wherein said centrally disposed shaft comprises a cylindrically shaped shaft having the distorted image arranged therewith.

7. An optical image generating toy as recited in claim 6, wherein said shaft carries an image displayed around said shaft.

8. An optical image generating toy as recited in claim 6, wherein said shaft is transparent and said image means is within said shaft.

9. An image generating means for an optical toy comprising a cylindrically shaped shaft having a medium arranged therearound, said medium having a distorted image imprinted thereon;

said shaft being hollow and transparent, said medium being arranged within said shaft; and a reflective parabolic surface having a central opening for receiving said shaft in a longitudinally cooperative manner, for the generation of a larger movably displayable image in undistorted form on said reflective surface.

* * * * *